US005545094A

United States Patent [19]

Hsu

[11] Patent Number: 5,545,094

[45] Date of Patent: Aug. 13, 1996

[54] GOLF CLUB SHAFT

[76] Inventor: Young-chen Hsu, 121, Sec. 1, Shen Lin Road, Taya Hsiang, Taichung Hsien, Taiwan

[21] Appl. No.: 518,250

[22] Filed: Aug. 24, 1995

[51] Int. Cl.[6] ..... A63B 53/10; A63B 53/12

[52] U.S. Cl. ..... 473/317; 473/319; 473/320

[58] Field of Search ..... 273/80 R, 80 B, 273/DIG. 23, DIG. 7, 80.6, 80.9

[56] References Cited

U.S. PATENT DOCUMENTS

| | | | |
|---|---|---|---|
| 1,917,795 | 7/1933 | Fetter | 273/80 R |
| 1,950,342 | 3/1934 | Meshel | 273/80 R |
| 2,018,723 | 10/1935 | Hutchinson . | |
| 3,083,969 | 4/1963 | Bills | 273/80 R |
| 4,836,545 | 6/1989 | Pompa | 273/80 B |
| 5,253,867 | 10/1993 | Gafner | 273/DIG. 23 |

FOREIGN PATENT DOCUMENTS

| | | | |
|---|---|---|---|
| 6-182007 | 7/1994 | Japan | 273/80 R |
| 20882 | 4/1909 | United Kingdom | 273/80 R |
| 327720 | 4/1930 | United Kingdom | 273/80 R |
| 434533 | 9/1935 | United Kingdom | 273/80 B |
| 1391768 | 4/1975 | United Kingdom | 273/80 B |

*Primary Examiner*—Sebastiano Passaniti

[57] ABSTRACT

A hollow golf club shaft has the first section and the second section. The first section has an inner layer which is made of viscoelastic-foam material and an outer layer which is made of carbon fiber reinforced plastic composite. The inner layer is enclosed by the outer layer. The first section has a non-circular cross-section such as a generally elliptic cross-section, a generally half elliptic cross-section, a generally pyriform cross-section, and a generally semicircular cross-section.

8 Claims, 6 Drawing Sheets

GOLF CLUB SHAFT

BACKGROUND OF THE INVENTION

The invention relates to a golf club shaft. More particularly, the invention relates to a golf club shaft with a non-circular cross-section.

Referring to FIG. 1, a conventional golf club comprises a head 2 and a shaft 1 which has a circular cross-section (as shown in FIG. 2). The upper portion of the shaft 1 is enclosed by a grip. The cross-sections of the shafts 1 of the golf clubs such as putters, iron clubs and wooden clubs are always in circular shapes. Since the stress is often concentrated at a predetermined position of the shaft 1, the shaft 1 may be bent or broken after a long period of usage.

SUMMARY OF THE INVENTION

An object of the invention is to provide a golf club shaft which has a non-circular cross-section for various golf clubs such as putters, iron clubs and wooden clubs.

Another object of the invention is to provide a golf club shaft which is made of a layer of viscoelastic foam material enclosed by a layer of carbon fiber reinforced plastic composite.

Accordingly, a hollow shaft which has a non-circular cross-section tapers downwardly. The lower end of the golf club shaft is inserted in a hose and the upper end of the golf club shaft is inside a handle. The golf club shaft is made of an inner layer of viscoelastic foam material which is enclosed by an outer layer of carbon fiber reinforced plastic composite. The viscoelastic foam material is easily formed in various non-circular cross-section shapes such as a generally elliptic shape, a generally half elliptic shape, a generally pyriform shape and a generally semicircular shape.

DETAILED DESCRIPTION OF THE INVENTION

Figure 1:
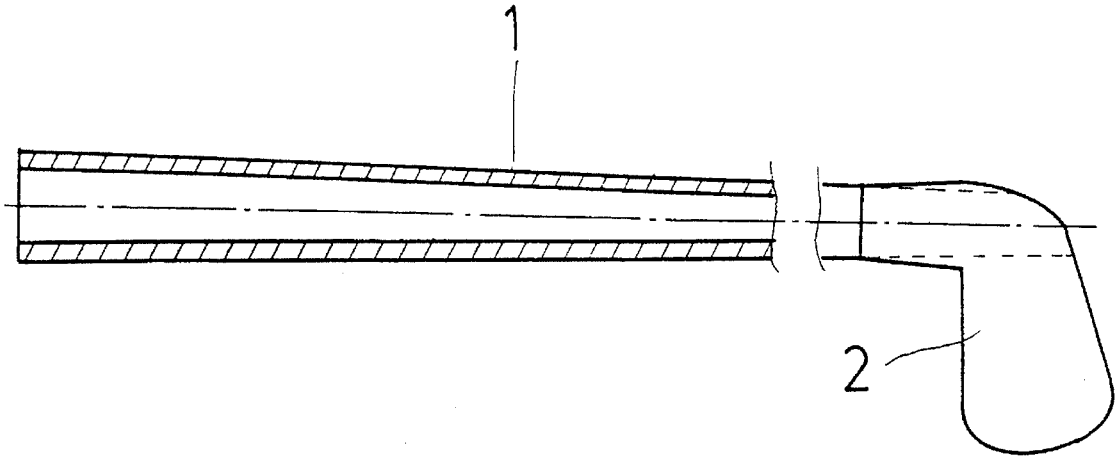
FIG.1 PRIOR ART
FIG. 1 is a plan view of a head and an upper portion of a shaft enclosed by a grip of the prior art.
Figure 2:
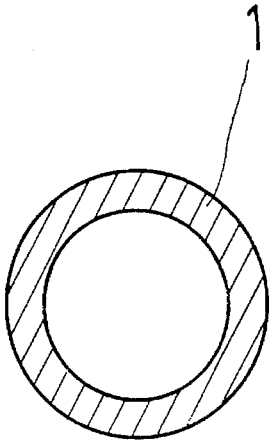
FIG.2 PRIOR ART
FIG. 2 is a cross-sectional view of a shaft in FIG. 1.
Figure 3:
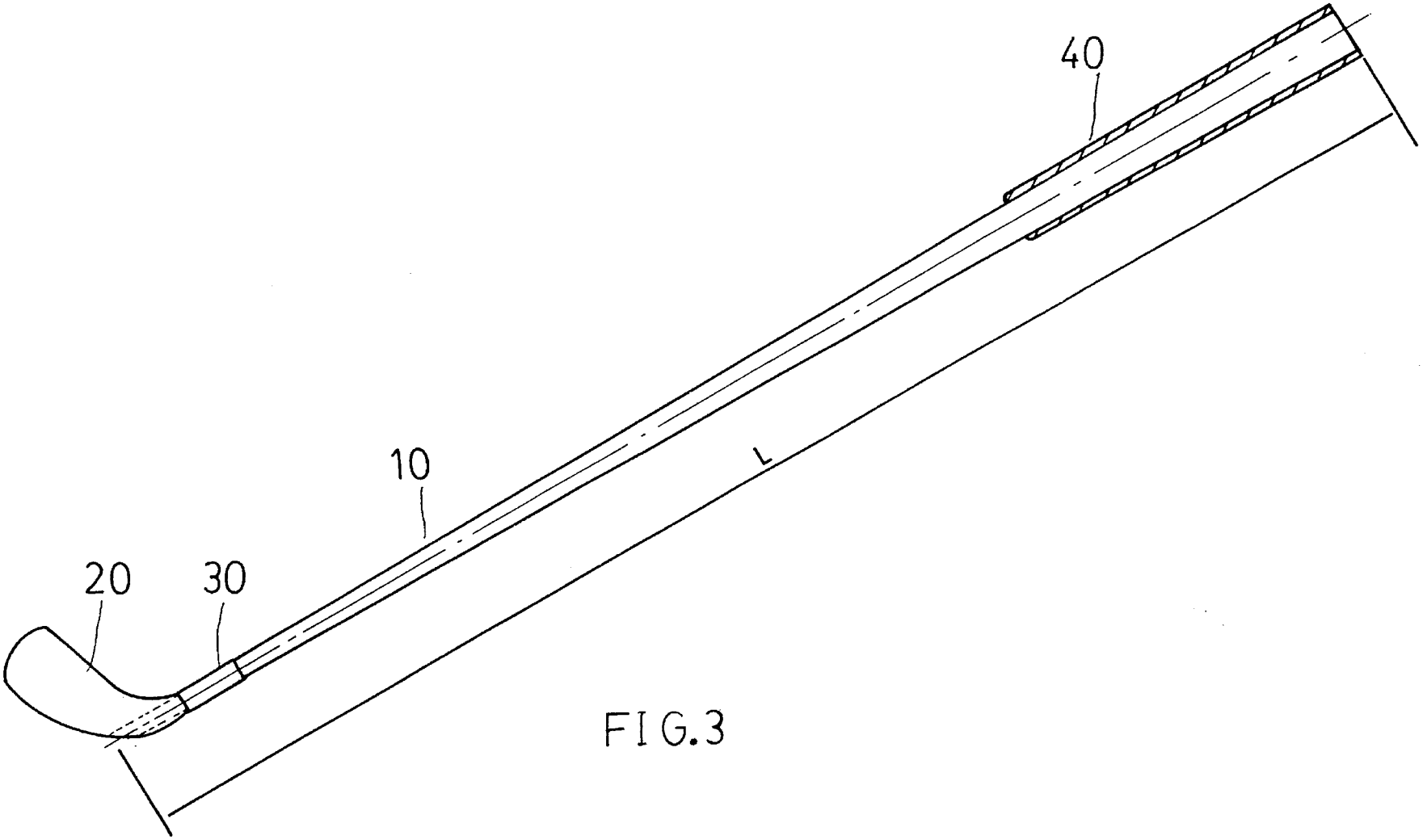
FIG. 3 is a plan view of a golf club of a preferred embodiment in accordance with the invention.
Figure 3A:
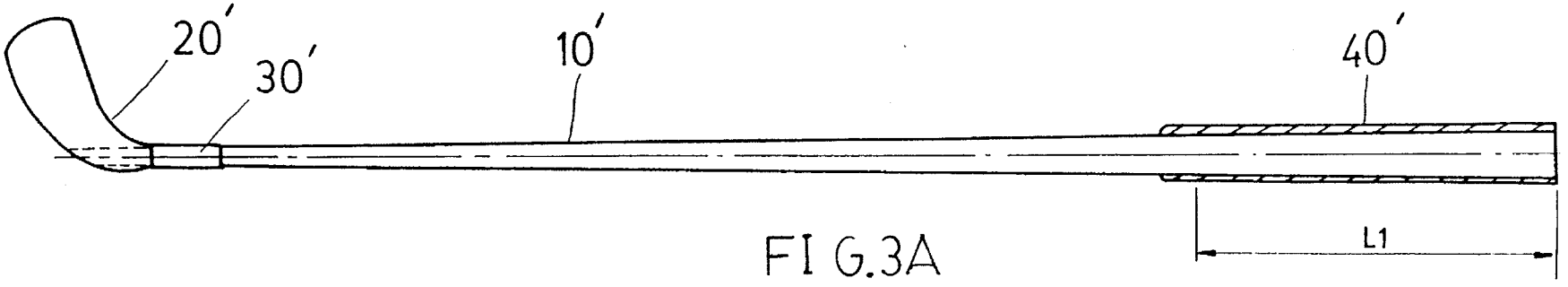
FIG. 3A is a plan view of a shaft of a second preferred embodiment in accordance with the invention.
Figure 3B:
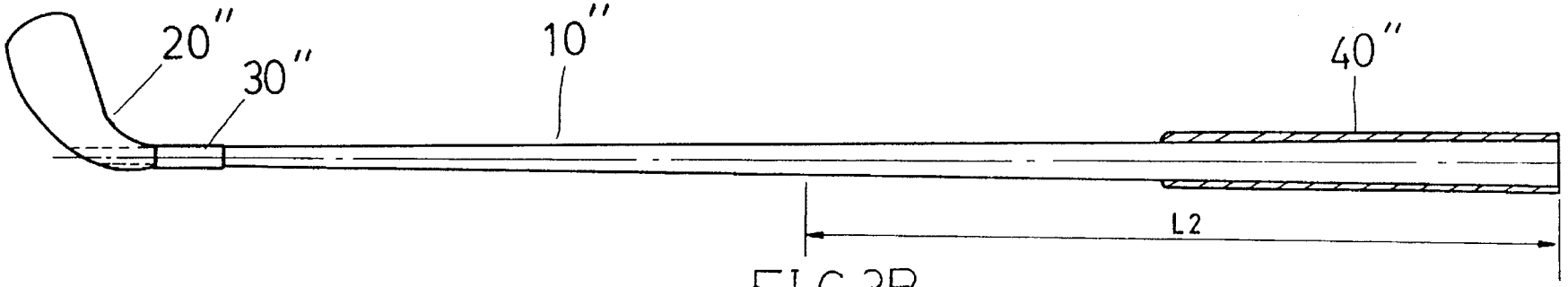
FIG. 3B is a plan view of a shaft of a third preferred embodiment in accordance with the invention.
Figure 3C:
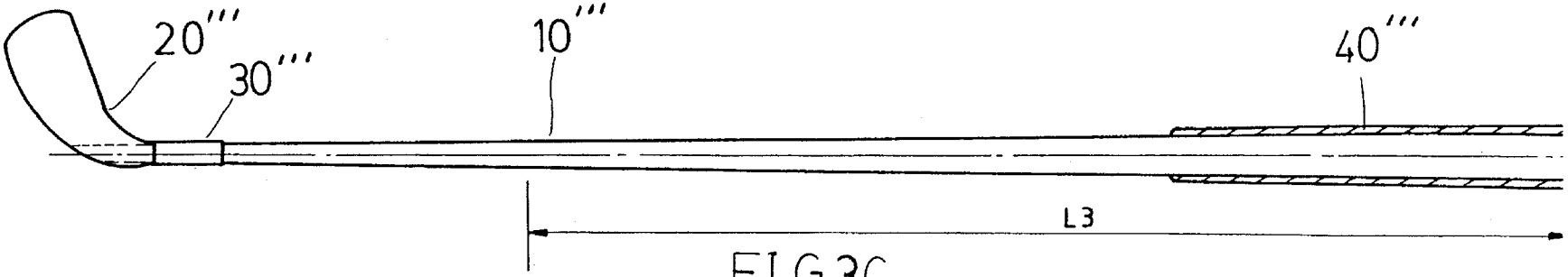
FIG. 3C is a plan view of a shaft of a fourth preferred embodiment in accordance with the invention.

FIGS. 3, 3A. 3B and 3C illustrate a hollow shaft 10, 10', 10" and 10'" with various arrangements for the shaft 10, 10', 10" and 10'" respectively FIG. 3 illustrates a single first sectional shaft 10 which is made of an inner layer of viscoelastic foam material and an outer layer of carbon fiber reinforced plastic composite. The length of the shaft 10 is denoted as L. FIG. 3A illustrates a two-sectional shaft 10 which has a first section with a length of L1. FIG. 3B illustrates a two-sectional shaft 10" which has a first section with a length of L2. FIG. 3C illustrates a two-sectional shaft 10'" which has a first section with a length of L3. Each of the first section of the shaft 10, 10' 10"or 10'" in FIG. 3 3A, 3B or 3C is made of an inner layer of viscoelastic foam material and an outer layer of carbon fiber reinforced plastic composite. Each of the second section of the shaft 10', 10" or 10'" in FIG. 3A, 3B or 3C is made of carbon fiber reinforced plastic composite.

FIG. 3 shows a golf club comprises a hollow shaft 10 which tapers downwardly, a hosel 30, a head 20 and a grip 40. The lower end of the shaft 10 is inserted in a hosel 30 and the upper end of the shaft 10 is inside a grip 40.

FIG. 3A shows a golf club comprises a hollow shaft 10' which tapers downwardly, a hosel 30', a head 20' and a grip 40'. The lower end of the shaft 10' is inserted in a hosel 30" and the upper end of the shaft 10' is inside a grip 40'.

FIG. 3B shows a golf club comprises a hollow shaft 10" which tapers downwardly, a hosel 30", a head 20'" and a grip 40". The lower end of the shaft 10" is inserted in a hosel 30" and the upper end of the shaft 10" is inside a grip 40".

FIG. 3C shows a golf club comprises a hollow shaft 10'" which tapers downwardly, a hosel 30'", a head 20'" and a grip 40'". The lower end of the shaft 10'" is inserted in a hosel 30'" and the upper end of the shaft 10'"is inside a grip 40'".

Figure 4:
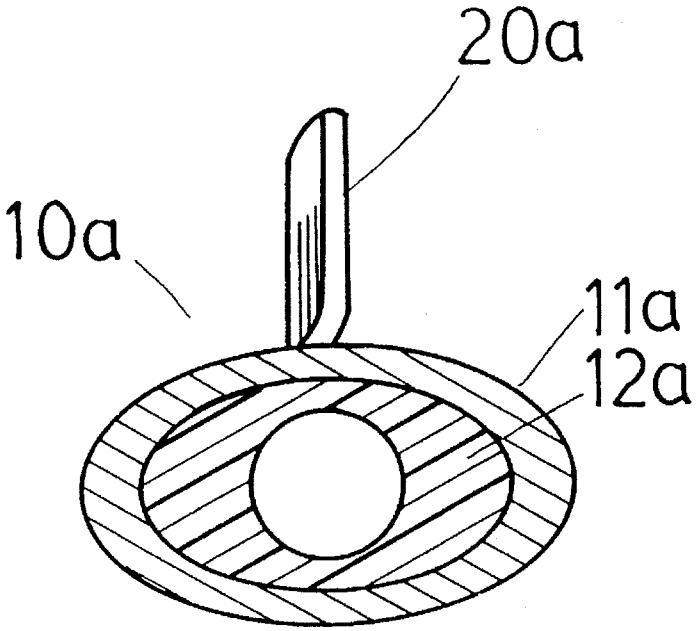
FIG. 4 is a cross-sectional view of a shaft with an elliptic cross-section.
Figure 8:
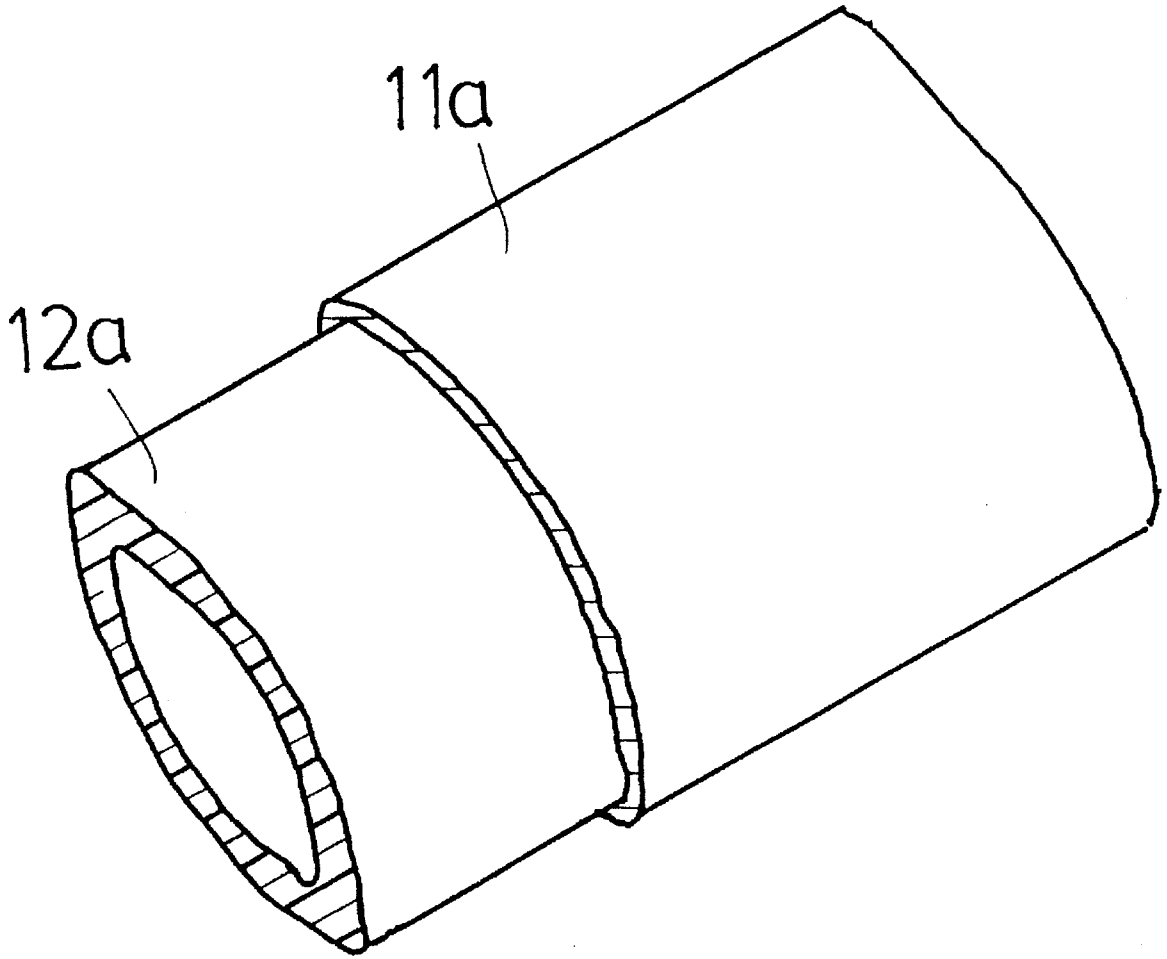
FIG. 8 is a partly sectional, perspective view of a shaft with an elliptic cross-section and illustrates an inner layer of viscoelastic foam material and an outer layer of carbon fiber reinforced plastic composite.

Referring to FIG. 4, the first section of the shaft 10, 10', 10' and 10'" in FIG. 3, 3A, 3B or 3C is denoted as **10*a*. The cross-section of the first section of the shaft 10*a* is in an elliptic shape with the ratio of the major axis to the minor axis from 1:0.95 to 1:0.6. The direction of the major axis is approximately perpendicular to the direction of the head 20*a* so that the rigidity of the shaft 10*a* is increased. The inner layer 12*a* is made of viscoelastic foam material, and the outer layer 11*a* is made of carbon fiber reinforced plastic composite. FIG. 8 illustrates a partly sectional perspective view of a shaft 10*a* which discloses an inner layer 12*a* and an outer layer 11*a***.

Figure 5:
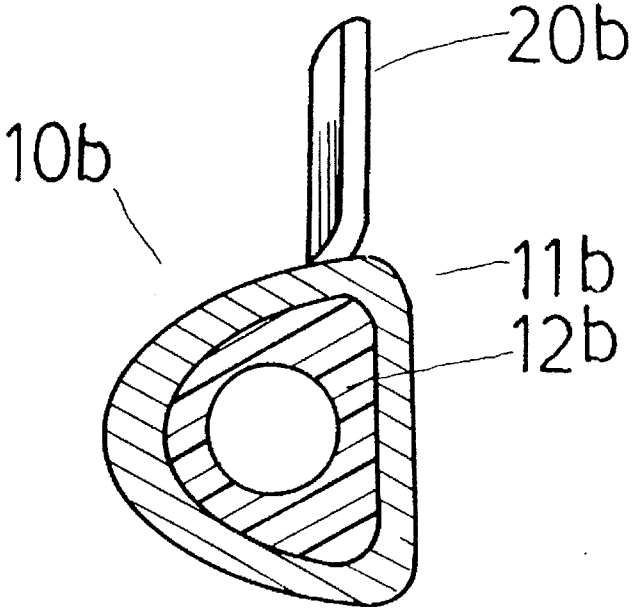
FIG. 5 is a cross-sectional view of a shaft with a half elliptic cross-section.

Referring to FIG. 5, the first section of the shaft 10, 10', 10" and 10'" in FIG. 3, 3A, 3B or 3C is denoted as **10*b*. The cross-section of the first section of the shaft 10*a* is in a half elliptic shape. The direction of the major axis is approximately perpendicular to the direction of the head 20*b* so that the rigidity of the shaft 10*b* is increased. The inner layer 12*b* is made of viscoelastic foam material, and the outer layer 11*b*** is made of carbon fiber reinforced plastic composite.

Figure 6:
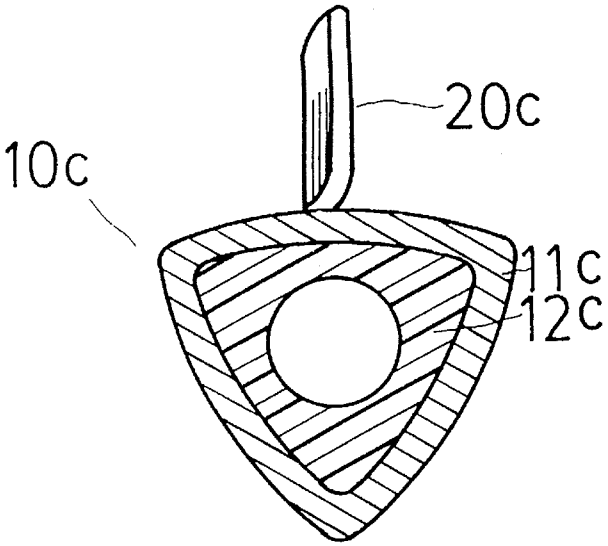
FIG. 6 is a cross-sectional view of a shaft with a pyriform cross-section.

Referring to FIG. 6, the first section of the shaft 10, 10', 10" and 10'" in FIG. 3, 3A, 3B or 3C is denoted as **10*c*. The cross-section of the first section of the shaft 10*c* is in a pyriform shape. The direction of the head 20*c* is generally parallel to the direction of one corner of the pyriform cross-section so that the rigidity of the shaft 10*c* is increased. The inner layer 12*c* is made of viscoelastic foam material, and the outer layer 11*c*** is made of carbon fiber reinforced plastic composite.

Figure 7:
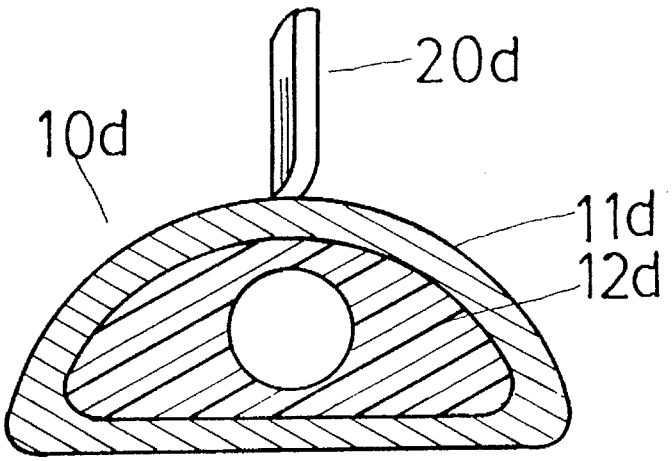
FIG. 7 is a cross-sectional view of a shaft with a semicircular cross-section.

Now referring to FIG. 7, the first section of the shaft 10, 10', 10" and 10'" in FIG. 3, 3A, 3B or 3C is denoted as **10*d*. The cross-section of the first section of the shaft 10*d* is in a semicircular shape. The direction of the head 20*d*** is approximately perpendicular to the direction of the linear side of the semicircular cross-section so that the rigidity of the shaft

10*d* is increased. The inner layer 12*d* is made of viscoelastic foam material, and the outer layer 11*d* is made of carbon fiber reinforced plastic composite.

Referring to FIGS. 3A, 3B and 3C again, the first section of the shaft 10', 10" and 10'" has a length of L1, L2 and L3, respectively. L1 is about ¼ of the length of the shaft 10'. L2 is about ½ of the length of the shaft 10". L3 is about ¾ of the length of the shaft 10'". Since different kinds of golf clubs need various length of the first section of the shaft, the length of L, L1, L2 or L3 only represents four preferred embodiments of the present invention. Further, the length of the first section of the shaft can be varied to match various golf club shafts.

The invention is not limited to the above preferred embodiments but various modification thereof may be made. It will be understood by those skilled in the art that various changes in form and detail may be made without departing from the spirit and scope of the invention.

What is claimed is:

1. A hollow golf club shaft comprising:

a tapered shaft which has a first section and a second section;

said first section having an inner layer which is made of viscoelastic foam material and an outer layer which is made of carbon fiber reinforced plastic composite;

said outer layer enclosing said inner layer;

said second section being made of carbon fiber reinforced plastic composite;

said first section having a non-circular cross-section; and said second section having a circular cross-section.

2. A hollow golf club shaft as claimed in claim 1, wherein said non-circular cross-section is in a generally elliptic shape.

3. A hollow golf club shaft as claimed in claim 1, wherein said non-circular cross-section is in a generally half elliptic shape.

4. A hollow golf club shaft as claimed in claim 1, wherein said non-circular cross-section is in a generally pyriform shape.

5. A hollow golf club shaft as claimed in claim 1, wherein said non-circular cross-section is in a generally semicircular shape.

6. A hollow golf club shaft as claimed in claim 1, 2, 3, 4, or 5, wherein the length of said first section is approximately one fourth of the length of said shaft.

7. A hollow golf club shaft as claimed in claim 1, 2, 3, 4 or 5, wherein the length of said first section is approximately half of the length of said shaft.

8. A hollow golf club shaft as claimed in claim 1, 2, 3, 4 or 5, wherein the length of said first section is approximately three fourths of the length of said shaft.

* * * * *